United States Patent [19]

Bernet

[11] 3,995,467

[45] Dec. 7, 1976

[54] GUIDING DEVICE FOR REVERSING THE DIRECTION OF TRAVEL OF FLAT METAL MATERIAL

[75] Inventor: Edouard Bernet, Terville, Moselle, France

[73] Assignees: Societe Lorraine de Laminage Continu(Sollack) S.A., Paris, France; Maschinenfabrik Sack GmbH, Dusseldorf-Rath, Germany

[22] Filed: July 3, 1975

[21] Appl. No.: 592,751

[52] U.S. Cl. ..... 72/205; 72/251

[51] Int. Cl.[2] ..... B21B 39/08

[58] Field of Search ..... 72/205, 229, 251, 231

[56] References Cited

UNITED STATES PATENTS

| | | | |
|---|---|---|---|
| 759,326 | 5/1904 | Swindell | 72/251 X |
| 2,189,329 | 2/1940 | Sendzimir | 72/205 |

*Primary Examiner*—Milton S. Mehr

*Attorney, Agent, or Firm*—John J. Dennemeyer

[57] ABSTRACT

A return guiding device for reversing the direction of travel of flat metal material and suitable in particular for inserting metal strip into so-called S-roller frames consists of a return guide shell having an area of small width occupied by rollers, so that during guidance the corners at the leading edge of the strip do not rest on the rollers but only on smooth edge regions of the return guide shell.

7 Claims, 3 Drawing Figures

Figure 1:
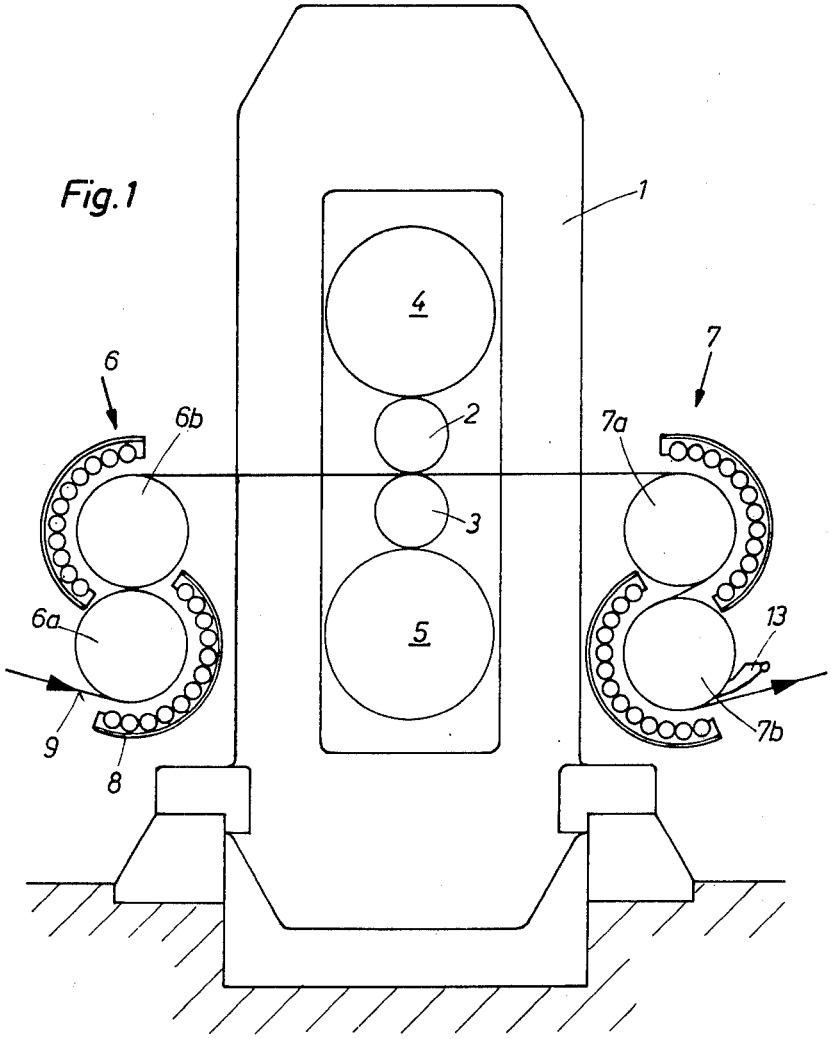

1
4
2
3
5
6
6b
6a
9
8
7
7a
13
7b

GUIDING DEVICE FOR REVERSING THE DIRECTION OF TRAVEL OF FLAT METAL MATERIAL

The invention relates to a shell-like return guiding device fitted with freely rotatable rollers for reversing the travelling direction of flat metal material and suitable in particular for introducing metal strip into roller traction devices, such as so called S-roller frames. A return mechanism of this kind is known for example from British Pat. Specification No. 1,119,098.

It has been observed that the corners of the leading edge of an incoming metal strip are bent up inwardly during the return curving operation forced on the strip during its travel through such mechanism so that the leading end of the strip is not gripped with certainty by the bight between two rolls or rollers. This effect can be explained that the leading edge of the metal strip being guided impinges repeatedly on the individual freely rotatable rollers, whereby the corners of the strip are bent inwardly as if by hammer blows.

This problem occurs in particular in cold strip rolling mills during further or final rolling of cold strip material during which process so-called S-roller frames are disposed on both sides of the rolling mill; the S-roller frames have braking rollers and traction rollers, respectively, the rollers being disposed one above the other or one behind the other and producing in the strip a high tension which is desired since the forward pull and the reverse pull produced in the strip by the coilers and uncoilers, respectively, are insufficient. This increased strip tension is necessary, in particular, in the case of thick strips; however, paradoxically the thicker strips are rolled in practice often without the use of the S-roller frames for the reason that in this case the bending deformation of the leading corners of the strip is particularly troublesome. Obviously the use of belt winders suggests itself in order to return the strips; however, it was observed in this case that the strips run off laterally. Furthermore, in another construction, the rollers have been omitted and smooth shell-shaped return guides have been used; however, the latter have too high a friction resistance so that the strip cannot be conveyed through.

It is an object of the invention to provide an operatively reliable shell-like return guiding device fitted with freely rotatable rollers for reversing the travelling direction of flat metal material, which in particular avoids bending deformation of the corners at the leading edge of the flat metal material, hereinafter referred to as strip.

To solve this problem the invention proposes a guiding device for reversing the direction of travel of flat metal material, comprising a guide shell having a curved inner surface and a plurality of rollers freely rotatably mounted in said guiding device to project from said inner surface of said guide shell, wherein said plurality of rollers occupy on said inner surface an area having a width which is smaller than the width of the narrowest strip of flat metal material intended to be guided by said guiding device, and wherein an edge region of said inner surface extending along either side of said area is free of said rollers.

In a device constructed in accordance with the invention, the strip is guided in this case only in its central region, in any case, not in its edge regions, by means of rollers which are disposed in rows which are preferably mutually offset, the rollers projecting sufficiently far from the smooth uninterrupted edge regions of the guiding device, whereby a compromise is made inasmuch as the curved roller-occupied area provides by far the largest amount of bending and guiding work in a largely frictionless manner, the corners of the strip sliding free of interference over the smooth edge regions of the guide shell.

For increasing the wear resistance and for improved guidance of the strip, the smooth roller-free edge regions of the guide shell are provided with a wear resistance lining either in that the lining material is attached thereto by rolling or in some other manner, or in that the wear resistant lining is produced by depositing it on the said edge regions by a welding process.

Figure 2:
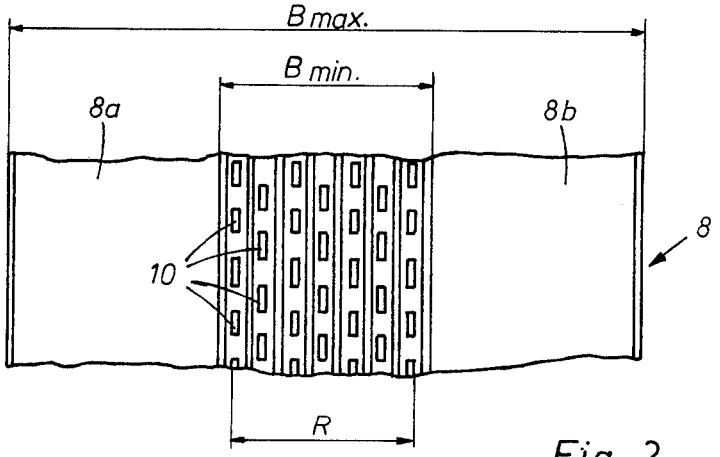
Figure 3:
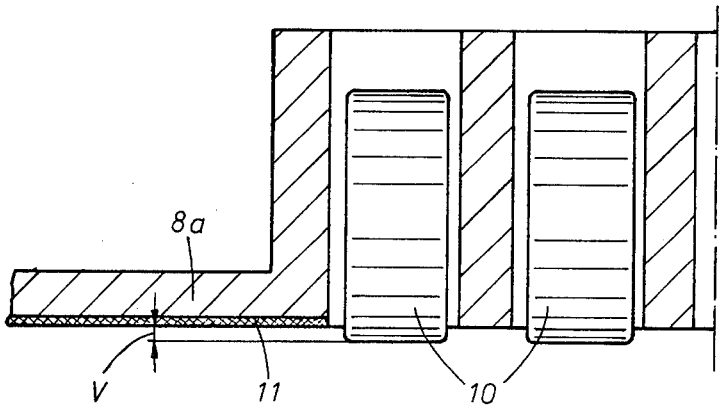

One embodiment of the invention is described below by way of example in conjunction with a cold strip rolling mill with reference to the accompanying drawings, in which;

FIG. 1 illustrates a cold strip rolling mill with two S-roller frames and shell-shaped return guiding devices associated therewith, FIG. 2 illustrates a portion of a shell-shaped return guiding device seen from inside, and FIG. 3 illustrates a partial horizontal section through a shell-shaped return guiding device.

A diagrammatically illustrated cold strip rolling mill 1 having two work rolls 2, 3 supported by two backing rolls 4, 5 is operatively associated at the entry side and the exit side with a respective S-roller frame 6 and 7 having brake roller pairs **6*a*, 6*b* and traction roller pairs 7*a*, 7*b* respectively. Incoming metal strip 9 is guided around each roller by means of a curved shell-shaped guiding device 8. The metal strip is to be rolled under high tension between the work rolls 2 and 3.**

As may be seen from FIG. 2, each guiding device 8 has a guide shell which is provided in its central region with a large number of loose rollers 10 which are disposed in mutually offset rows and which form a roller field having a width R. According to the invention this width R is smaller than the width B min of the narrowest metal strips 9 to be returned in practice. The overall width of the guide shells of the guiding device 8 is not less than that of the maximum strip width B max. to be handled by the device.

It may be seen from FIG. 3 that the freely rotatable rollers 10 project by an amount V over the roller-free edge regions **8*a* and 8*b* of each guide shell. This amount V is so selected that even when metal strip of the maximum width B max. is due to be returned at most the edge regions of the strip slide along the roller-free edge regions 8*a* and 8*b* of the guide shells 8,** since the major bending and guiding work is effected by the roller field, namely in a manner largely free of friction.

The edge regions **8*a* and 8*b* of the guide shells 8 are provided with a wear resistance lining 11.**

Upon entry a strip 9 which travels from a coil, not illustrated, by way of an entry table into the lower shell-like guiding device 8 of the S-roller frame 6 disposed on the entry side of the rolling mill. The sliding friction normally occurring upon entry into the return guiding device is reduced by the rollers 10 to a rolling friction which is only a small fraction of the sliding friction previously experienced, so that the strip is not jammed and does not produce an interruption or standstill of the work continuity.

After the strip has been guided by the S-roller frame on the entry side through an S-shaped path it travels, after having embraced the brake roller 6*b*, between the work rolls 2, 3 of the cold strip rolling mill 1 in a horizontal direction, if necessary held down by presser rollers (not illustrated). At the exit side of the mill, the strip is inserted into the upper guiding device of the second S-roller frame 7, the strip being guided thereby again in the manner described above with reference to the S-roller frame 6. When it leaves the lower tension roller 7*b* the strip is deflected into a desired direction by means of a doctor blade 13 or an equivalent device.

What is claimed is:

1. A guiding device for reversing the direction of travel of flat metal material, comprising: a guide shell having a curved inner surface; and a plurality of rollers freely rotatably mounted in said guiding device to project from said curved inner surface of said guide shell, wherein said plurality of rollers occupy on said curved inner surface an area having a width which is smaller than the width of the narrowest strip of flat metal material intended to be guided by said guiding device, and wherein a smooth edge region of said curved inner surface extends unbrokenly along both sides of said area occupied by said plurality of rollers, and is free of said rollers.

2. A guiding device according to claim 1, wherein the rollers are disposed in mutually offset rows.

3. A guiding device according to claim 1, wherein said smooth end regions of said curved inner surface are provided with a wear resistant lining.

4. In a roller traction device, a cylindrical traction roller; and a guiding device mounted in closely spaced relationship to said traction roller, said guiding device including: a guide shell having a curved inner surface presented to the outer surface of said traction roller in closely spaced relationship; and a plurality of rollers mounted centrally of said guide shell to project from said curved inner surface thereof, said rollers being mounted for free rotation about axes extending parallel to the axis of said traction roller and defining an imaginary curved surface disposed closer to said traction roller than said curved inner surface of said guide shell, said plurality of rollers occupying an area on said curved inner surface of said guide shell having a width which is smaller than the width of the narrowest strip of flat metal material intended to be guided by said guiding device, and the end regions of said curved inner surface of said guide shell along both sides of said plurality of rollers being smooth and unbroken.

5. In a roller traction device as claimed in claim 4, wherein said traction roller is mounted in a so-called S-roller frame.

6. In a roller traction device as claimed in claim 4, wherein the rollers are disposed in mutually offset rows.

7. In a roller traction device as claimed in claim 6, wherein said smooth and unbroken end regions of said curved inner surface of said guide shell are provided with a wear resistant lining.

* * * * *